United States Patent [19]

Dunham et al.

[11] 4,319,524

[45] Mar. 16, 1982

[54] ABRASIVE STENCILING APPARATUS

[75] Inventors: Philip N. Dunham, Biddeford; Armand Martin, Saco; Gregory G. A. Peck, Biddeford, all of Me.

[73] Assignee: Prevent-A-Theft International Ltd., Biddeford, Me.

[21] Appl. No.: 123,108

[22] Filed: Feb. 20, 1980

[51] Int. Cl.[3] ..... B05C 17/08; B41L 13/02; G09F 7/08

[52] U.S. Cl. ..... 101/128; 40/620; 51/310; 101/114; 101/370

[58] Field of Search ..... 101/128, 114, 128.1, 101/48, 112, 370, 380, 381, 393, 396; 51/310, 311, 312; 40/618, 620

[56] References Cited

U.S. PATENT DOCUMENTS

| | | | |
|---|---|---|---|
| 159,725 | 2/1875 | Warren | 101/128 |
| 205,142 | 6/1878 | Rouse | 40/618 |
| 810,979 | 1/1906 | Richards | 101/387 |
| 832,925 | 10/1906 | Rudolph | 101/128 |
| 1,156,672 | 10/1915 | Davis | 101/381 |
| 1,509,223 | 9/1924 | Beghetti | 101/128 |
| 1,811,167 | 6/1931 | Anderson | 101/128 |
| 2,152,274 | 3/1939 | Papazian | 101/114 |
| 2,540,718 | 2/1951 | Duskin | 40/618 |
| 3,545,996 | 12/1970 | Duncan | 51/312 |
| 3,624,966 | 12/1971 | Palmer | 101/114 |

FOREIGN PATENT DOCUMENTS

| | | | |
|---|---|---|---|
| 759381 | 11/1933 | France | 101/114 |
| Ad.4517 | of 1910 | United Kingdom | 101/114 |

*Primary Examiner*—Clyde I. Coughenour
*Attorney, Agent, or Firm*—Morse, Altman, Oates & Dacey

[57] ABSTRACT

Apparatus is provided for making a permanent mark on a hard surface such as glass or the like primarily for identification purposes. A hand held gun connected to a source of compressed air is adapted to drive a stream of abrasive particles towards a stenciling head on the marking end of the gun, which is held against the surface to be marked. The head carries interchangeable stencils located in the path of the stream of abrasive particles when the gun is actuated. When the stencil head of the gun is held flat against the surface which is to be marked and the gun actuated, the stencil indicia will be formed on the surface by the action of the abrasive particles abrading and etching the surface through the stencil openings. The stencil elements are formed by photo engraving techniques to produce sharp, precise characters and the elements themselves fit snugly together when assembled to prevent leakage between adjacent elements. A holder in the head provides a mount for a plurality of stencil elements and allows elements to be changed as required.

2 Claims, 20 Drawing Figures

ABRASIVE STENCILING APPARATUS

BACKGROUND OF THE INVENTION

1. Field of the Invention

This invention relates generally to stenciling equipment and more particularly is directed towards a new and improved apparatus for stenciling identification indicia by air driven abrasive particles onto a window of a motor vehicle or the like for purposes of inhibiting the theft thereof.

2. Description of the Prior Art

There has developed in recent years a new technique for reducing the risk of theft of various products, especially automobiles. The technique has involved the etching of an identifying code number onto the windshield of the vehicle. Code systems are utilized in conjunction with central registries so that, if an owner of a marked car needs to be identified, it is a simple matter to check the code number which has been etched onto the glass of the windshield and all other windows with a central registry in order to identify and locate the true owner of the vehicle. Because of the time, difficulty and costs involved either in obliterating or altering the identification number on the windshield or in replacing the entire windshield, thieves are deterred from stealing vehicles which are so marked.

Equipment currently available for etching an identification code on windshields or other glass areas have involved gun-like devices that are connected to a source of compressed air and are adapted to direct a stream of abrasive particles against a stencil located at the head of the gun and which is placed against the glass surface to be marked. While the technique of using a stream of abrasive particles to etch glass or other hard surface with an identification code of other indicia has proven to be a successful deterrent to theft, there do exist certain problems with respect to the stencil head of the gun employed for this purpose. These problems have generally involved the production of stencils of sharp outline and a head and stencil configuration which permits quick and easy changing of stencils in order to change code numbers rapidly. Other problems have developed with respect to small leaks between stencils which produce spurious markings on the glass surface.

Accordingly, it is an object of the present invention to provide a new and improved stenciling gun for use in etching identification indicia on glass surfaces or the like wherein stencils of sharp outline can be quickly and easily changed.

Another object of this invention is to provide a head assembly for abrasive stenciling guns in which one or more sets of identification stencils may be quickly and easily assembled without leakage between stencils and of a configuration which prevents improper mounting of individual stencils.

SUMMARY OF THE INVENTION

This invention features a stencil head assembly for use with a gun adapted to direct a stream of abrasive particles against a stencil assembled in a head for use in etching identification indicia onto the surface of glass or other hard surface, comprising a resilient cupped head adapted to fit over the discharge end of the gun and adapted to carry a stencil holder mounted across the front thereof. The holder is formed with one or more slots along which individual photo-engraved stencils are mounted in side-by-side butting relation, each stencil having a raised portion slightly off center in which the stencil character appears. Side edges are bevelled whereby, when assembled together, one stencil will slightly override the adjacent stencil to eliminate leakage and the offset configuration prevents improper insertion of stencils. The holder is constructed to prevent improper mounting of the head onto the gun and allows the stencils to be changed quickly and easily, as required.

DETAILED DESCRIPTION OF THE PREFERRED EMBODIMENTS

Figure 1:
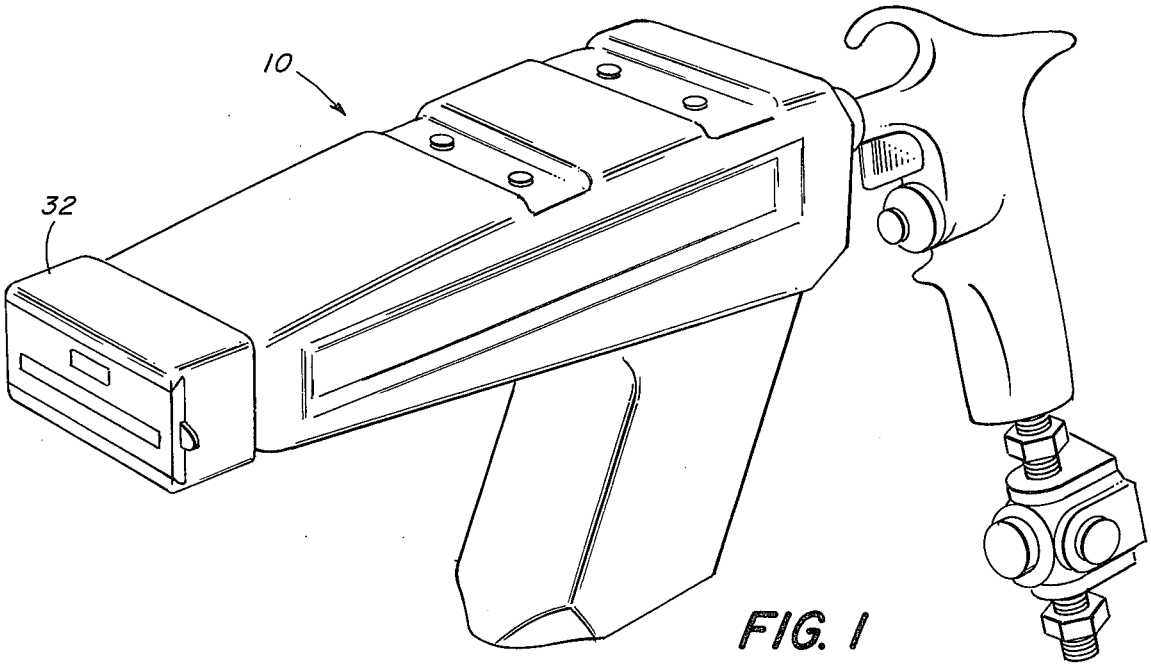
FIG. 1 is a view in perspective of an etching gun equipped with a stencil head made according to the invention.
Figure 2:
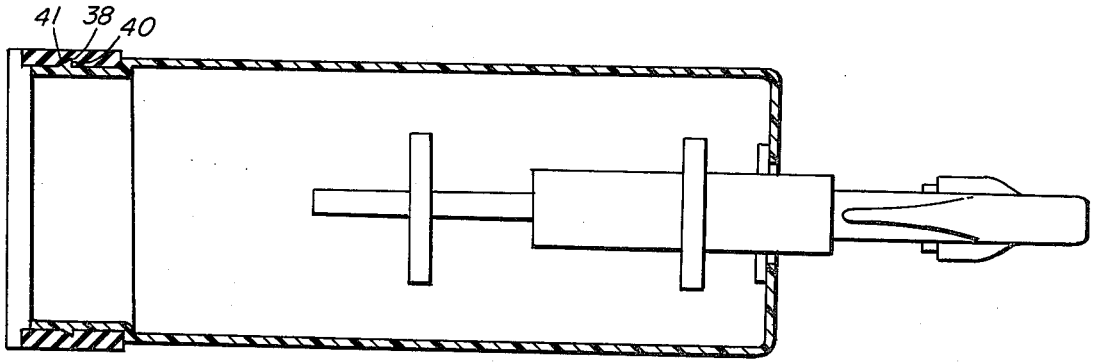
FIG. 2 is a top sectional view of the FIG. 1 device.
Figure 3:
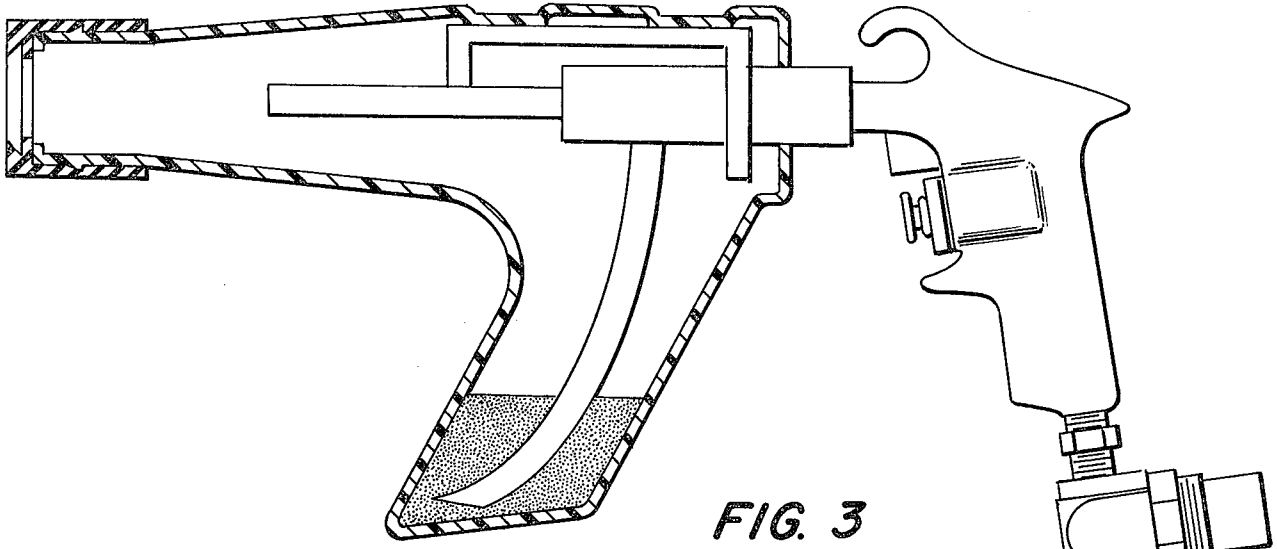
FIG. 3 is a sectional view in side elevation of the FIG. 1 device.
Figure 5:
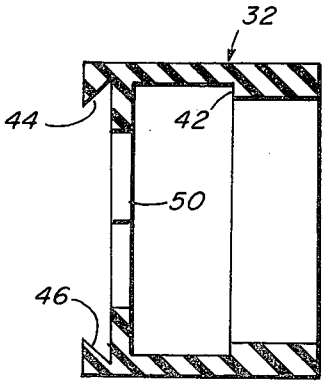
FIG. 5 is a cross-sectional view taken along the line 5—5 of FIG. 4.
Figure 4:
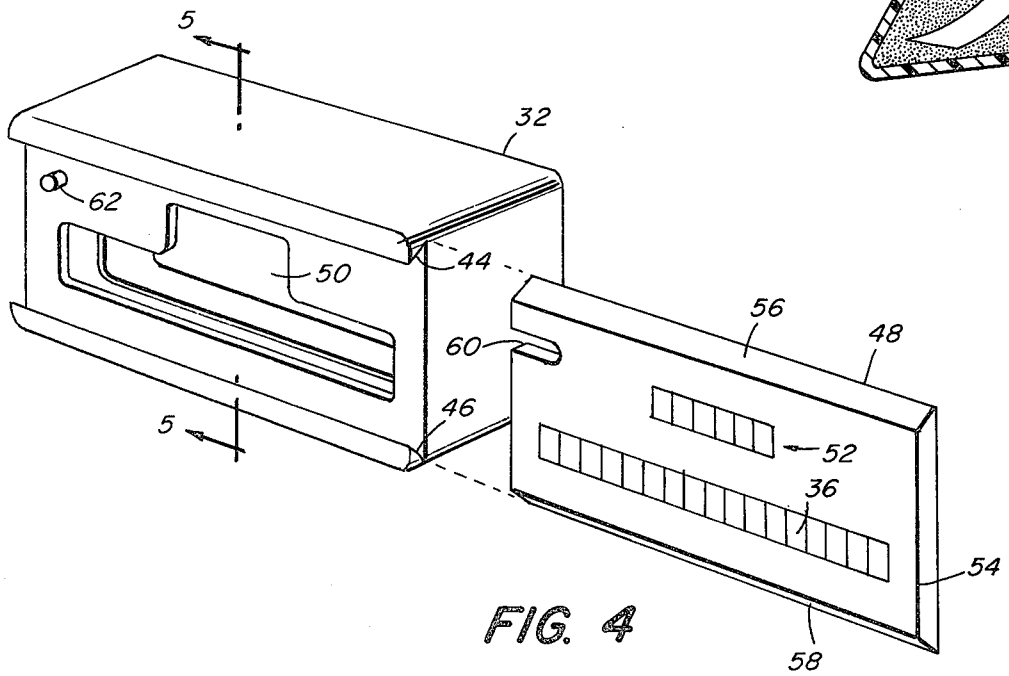
FIG. 4 is an exploded perspective view of the head assembly.

Referring now to the drawings, the reference character 10 generally indicates a stenciling apparatus in the form of gun-shaped housing 12 conveniently molded from plastic, stamped from metal, or otherwise formed with an upper casing portion 14 and a lower handle portion 16 in communication therewith. Attached to the rear of the casing is a pistol grip 18 provided with a finger-operated valve 20 and connected by means of a conduit 22 to a source of compressed air. This portion of the apparatus is more fully disclosed in U.S. Pat. No. 4,164,183. In general, the air pistol is provided with a nozzle 24 extending into the rear of the casing and pivoted thereto for limited movement in a plane generally transverse to the upper casing portion 14 and directed towards the discharge end of the apparatus. The air nozzle 24 is connected to a pick-up tube 26 extending down into the handle 16 of the casing where a quantity of abrasive particles 28 such as aluminum oxide, or the like, is stored. When the air gun is actuated, the abrasive particles are drawn up the tube 26 and discharged at a high velocity through the nozzle 24 towards the discharge end of the apparatus.

Mounted to the discharge end of the apparatus is a stencil head 30 comprised of a somewhat rectangular cup 32 that fits over the end of the casing and is provided with a removable holder 34 in which is mounted one or more individual stencils 36 positioned along the path of travel of the abrasive particles whereby, when the apparatus is actuated and the face of the head assembly 30 is placed flat against a surface such as windshield for example, the particles will etch whatever indicia appears on the stencil onto the glass surface. The resulting etched marking is permanent and, when used to apply an identification code of alphanumeric characters for example, provides a very effective deterrent to the theft of the vehicle because of the high cost of replacing all windows marked with such a code or serial number.

The cup 32 of the preferred embodiment is fabricated from a soft, flexible material such as an elastomer which provides resistance to damage by the abrasive particles and at the same time forms a snug fit over the end of the casing. As shown, the casing is formed with an outer rib 38 defining a rearwardly facing shoulder 40 and a sloped forward face 40 which cooperatively engages a corresponding inner shoulder 42 formed in the cup 32 whereby when the cup is pressed over the end of the casing, the rib 38 of the casing will bear against the shoulder 42 in the cup to hold the cup firmly in place. In view of the fact that the cup 32 is of an elastomeric material, it can be separated from the gun by stretching and pulling the cup away from the tip of the apparatus.

The front of the cup is formed with oppositely facing dovetailed grooves 44 and 46 along the top and bottom edges thereof to receive a stencil holder 48 which is mounted by sliding it across the front of the cup from one side thereof. The front wall of the cup is formed with an opening 50 in the shape of an inverted T to align with corresponding openings in the stencil holder to expose individual stencil elements 36 which, in the illustrated embodiment, are arranged in a relatively short upper row 52 and a relatively long lower row 54.

The stencil holder 48 is generally rectangular in outline, formed with upper and lower bevelled edges 56 and 58 that mate with the upper and lower grooves in the front of the cup 32 whereby the holder may be slid into position across the face of the cup. In order to insure that the holder is properly inserted, the holder is formed with a notch 60 at the left hand end thereof as viewed in FIG. 1 in position to engage a boss 62 formed in the front of the cup at the left hand end thereof. Thus the holder 48 may be inserted from one side only of the cup and cannot be installed upside down or in a reversed position insofar as the holder will fit in one position only on the cup.

Figure 6:
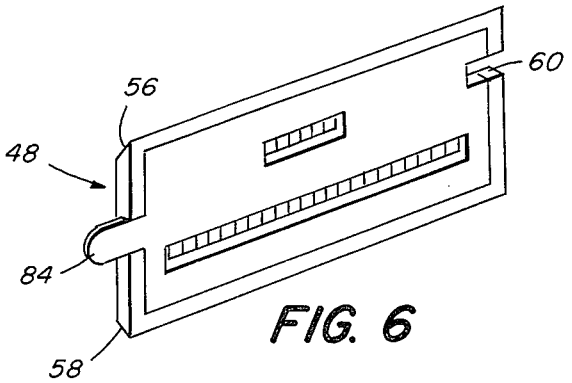
FIG. 6 is a rear perspective view of the stencil holder.

The holder 48 may be fabricated from various materials and, in practice, a relatively hard molded plastic has been found satisfactory although other materials such as metal, or the like, may be used to advantage. The holder is comprised of two separable sections namely a face plate 64 and a backing plate 66. The face plate 64 as best shown in FIGS. 6, 7, 8 and 9 is comprised of a flat front wall having a pair of rectangular apertures 68 and 70 formed therein in which individual stencil elements appear. The face plate 64 also includes a recess 72 in the back thereof of a size and shape to receive the backing plate 66 as shown in FIG. 6. The face plate 64 is formed with a pair of internal slots 74 and 76 open to the apertures 68 and 70 and extending lengthwise thereof, each slot terminating at one end with an enlarged opening 78 and 80 through which individual stencil elements may be inserted or removed. The openings 78 and 80 at the ends of the slots are of a size and shape to accommodate stencil elements 36 placed therein while the remaining portion of the slot is restricted both at front and rear so that the stencil element will be held in position once moved along the slot. Stencil elements 36 therefore are easily changed by merely sliding the elements along the slots through the end openings as required. The face plate 64 is also formed with a notch as previously described at one end thereof and offset from the center. At the opposite end of the face plate is another notched section 82 to receive a cooperating tab 84 formed on one end of the backing plate 66 by means of which the backing plate may be pried loose from the face plate 64 when changing stencil elements.

Figure 10:
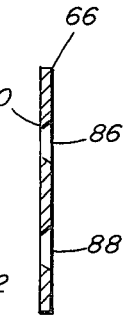

The backing plate is best shown in FIG. 10 and is formed with upper and lower rectangular apertures 86 and 88 which register with the apertures 68 and 70 in the face plate 64 and are formed with bevelled edges and narrow ribs 90 along the edges thereof which seal against the backs of the stencil elements to hold them tightly in place. The bevelled edges of the apertures 86 and 88 serve to direct the abrasive particles into the apertures and through the openings in the stencil elements 36.

Figure 11:
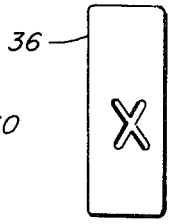
FIG. 11 is a view in rear elevation of a stencil made according to the invention.
Figure 12:
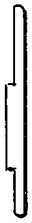
FIG. 12 is a view in side elevation thereof.
Figure 13:
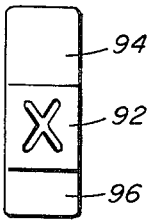
FIG. 13 is a view in front elevation thereof.
Figure 7:
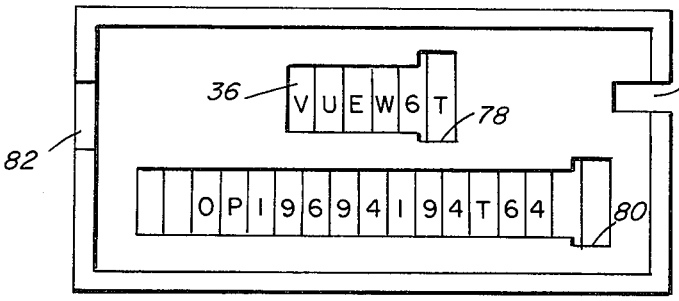
FIG. 7 is a rear elevation of the front element in the holder.
Figure 8:
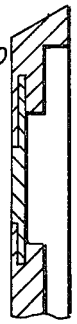
FIGS. 8, 9 and 10 are cross-sectional views of individual components of the holder.
Figure 9:
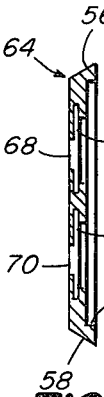

It will be noted in FIG. 8, which shows an enlarged detail of the face plate 64 and a single row of stencil elements, that the slot for the stencil elements is formed with an upper groove above each aperture which is wider than a lower groove below each aperture, with the result that the opening for the stencil is slightly below the centerline of the slot. With this configuration and using stencil elements 36 such as shown in FIGS. 11, 12 and 13, it is impossible to install the stencil elements either in an inverted position or in a backward position. This is due to the fact that each stencil element 36 is formed with a relatively thick mid-portion 92 which is slightly below the centerline of the element and is formed with a relatively wide top flange 94 and a relatively narrow bottom flange 96 corresponding to the width of the upper and lower grooves in the face plate slots 74 and 76.

The stencil indicia, which typically may be an alphanumeric character, is formed in the relatively thick mid portion 92 of each stencil element 36 and, while alphanumeric characters are indicated, obviously other indicia such as logos, trademarks, decorations, or the like, may be provided. The height of each thick mid portion 92 of each stencil corresponds with the height of an aperture in the face plate. Also the mid portion of each stencil element extends from the face of the element by an extent generally corresponding with the thickness of the front groove wall whereby, with the stencil element in position, the front face of each stencil element will be substantially flush with the front surface of the face plate 64. In this fashion, when the head of the apparatus is placed flat against the surface to be etched, such as a windshield, for example, the stenciling elements will be flush against that surface so as to eliminate any leakage of abrasive particles which would cause the images to be blurred.

Figure 14:
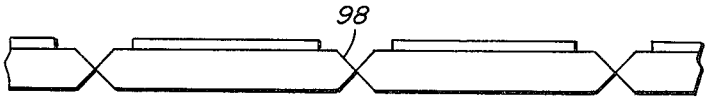
FIG. 14 is a top plan view of several stencils assembled in side-by-side relation.

As a further means for preventing spurious markings from being produced on the surface to be etched, the long edges at least of each element are bevelled at 98 as best shown in FIG. 14, so that when the stencils are butted one against the other, one stencil will slightly override the adjacent stencil to fully seal one against the other. Thus there is no leakage between adjacent stencil elements and the image produced on the glass surface or the like is free and clear of spurious etching lines.

According to the present invention, the individual stencil elements preferably are fabricated by photo-engraving techniques using copper blanks as the stencil material. By using photo-engraving procedures, extremely sharp stencil characters can be produced with a resulting high quality stencil image being etched onto the glass surface. Further, the photo-engraving techniques allow for a wide variety of indicia to be formed on these stencils, both alphanumeric characters as well as decorations, logos etc. Also, by using the photo-engraving techniques it is possible to produce the raised mid portion 92 by etching away the material above and below the mid portion to produce the relatively wide upper flange 94 and the relatively narrow lower flange 96. The engraving also makes possible the formation of the bevelled edges 98 to provide the desired sealing action between adjacent elements.

Figure 15:
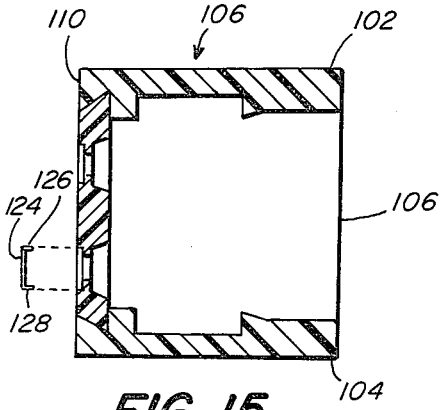
FIG. 15 is a sectional view in side elevation showing a modification of the invention.
Figure 16:
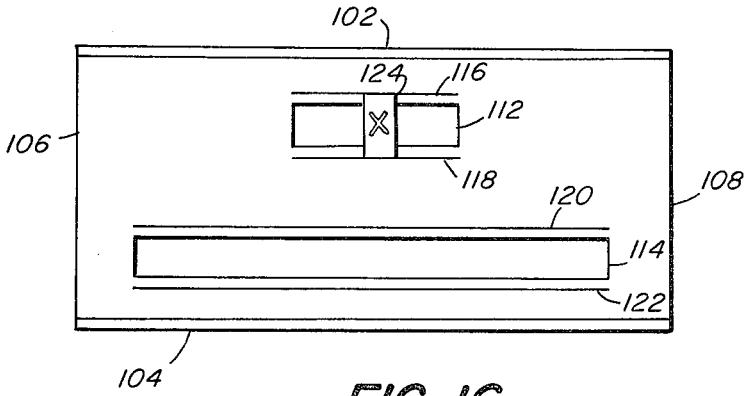
FIG. 16 is a view in front elevation thereof.

Referring now to FIGS. 15 and 16 of the drawings, there is illustrated a modification of the invention and, in this embodiment, a cup 100 is provided that is similar in structure and functions to the cup 32 of the principal embodiment. The cup 100 is fabricated entirely of a soft flexible material, preferably an elastomer, has an outer configuration similar to that of the cup 32 and is dimensioned to fit snugly over the end of the casing, as before. The cup 100 is formed with rearwardly extending top, bottom and side walls 102, 104 and 106 respectively. The front is formed with dovetailed upper and lower grooves 108 and 110 to receive a flexible stencil holder 112. The holder 112 slides in and out of the dovetailed grooves and is formed with a pair of apertures 114 and 116 each of which is a slit groove 118, 120, 122 and 124. No other holder parts for stencil elements are needed in this modification, but rather individual elements 126 are mounted directly to the flexible holder 112. The stencil elements 126 in this embodiment are similar to those of the principal embodiment with the exception that the upper and lower flanges 128 and 130 are bent back rearwardly along fold lines 132 and 134 for insertion in the slit grooves 118, 120 of the upper aperture 114, 122 and 124 for the lower aperture 116. The flange 128 is shorter than the flange 130 to ensure that the stencil elements are inserted all in the same upright position across their respective apertures. Individual stencil elements are easily separated from the holder 112 by merely deforming the holder so as to allow the element to drop from or be picked out of the slit grooves.

Referring now to FIGS. 17 through 20, there is illustrated another modification of the invention and, in this embodiment, there is shown a stencil holder 136 that may be used with the cup 32 of the principal embodiment. The stencil holder 136 is generally comprised of two parts, namely a front piece 138 and a backing plate 140. The front piece 138 is generally rectangular in front elevation and, preferably, is molded from a slightly flexible, semi-rigid material such as a suitable plastic. The front piece is formed with bevelled upper and lower edges 142 and 144 which slidably engage the dovetailed grooves formed in the cup 32.

The inner or rear face of the front piece is formed with a shallow recess 146 which receives the rectangular backing plate 140. The upper and lower inner edges of the recess 146 are slightly dovetailed to receive the upper and lower tapered edges 148 and 150 of the backing plate 140. The front piece is also formed, in the illustrated embodiment, with a pair of parallel apertures 152 and 154 in which individual stencil elements 156 are mounted.

Figure 18:
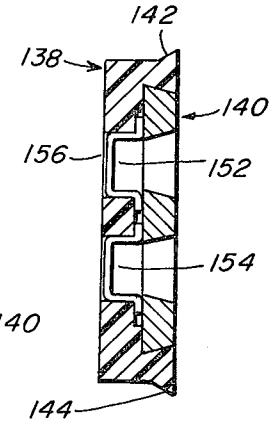
FIG. 18 is a cross-sectional view taken along the line 18—18 of FIG. 17.
Figure 17:
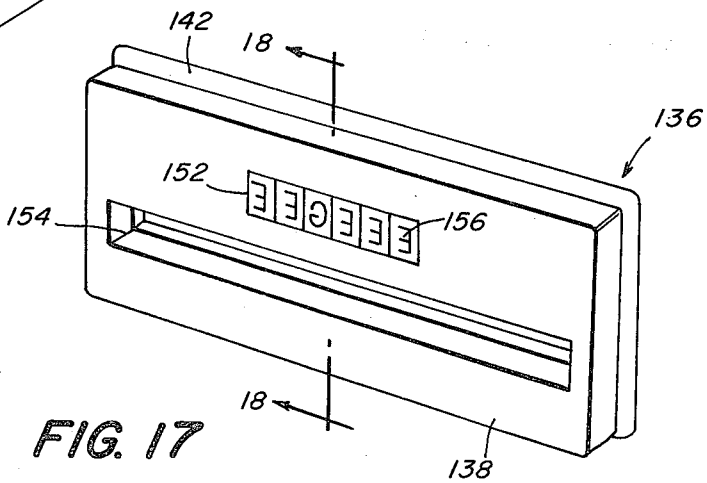
FIG. 17 is a perspective view of another modification of the invention.
Figure 19:
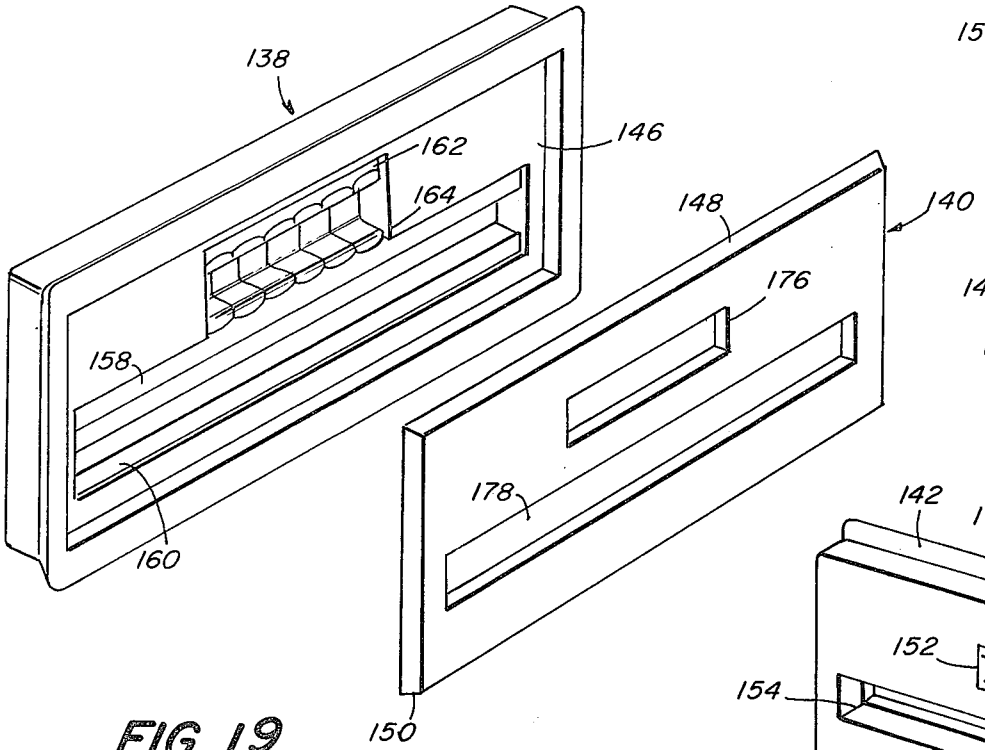
FIG. 19 is an exploded rear perspective view of the FIG. 17 embodiment.

The apertures 152 and 154 are open through the wall of the front piece and on the rear face of the front piece, directly adjacent the upper and lower edges of both apertures, are very shallow recesses 158 and 160 for the lower opening and 162 and 164 for the upper aperture. The depth of these very shallow recesses generally corresponds with the thickness of the stencil elements so that, once placed therein they are generally flush with the back of the front piece wall as best shown in FIG. 18.

Figure 20:
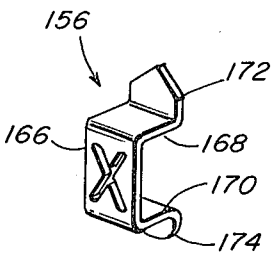
FIG. 20 is a perspective view of an individual stencil element employed in the FIG. 17 embodiment.

These stencil elements 156, as best shown in FIG. 20, are generally U-shaped being formed with a flat front portion 166 in which the indicia is present and top and bottom rearwardly extending legs 168 and 170 terminating in an upturned flange 172 at the end of the leg 168 and a downwardly turned flange 174 for the leg 170. Preferably, the contour of the flanges 172 and 174 differ from one another so that, when installing the stencil elements, all will be in the same upright position. Typically, the upper flange 172 may be pointed while the lower flange 174 may be square or rounded, for example. In any event the stencil elements are placed side by side in the apertures in the manner shown in FIGS. 16 and 18. Once all of the stencil elements are in place, the backing plate is pressed into the recess 146 and the entire holder is then slipped into the cup, as before.

The backing plate 140 is dimensioned to fit snugly into the recess 146 and is formed with upper and lower apertures 176 and 178 which register with the apertures 152 and 154 in the front piece. The edges of the apertures are bevelled, as shown, to direct abrasive particles into the apertures to enhance the abrasive action. The backing plate when installed presses against the flanges of the stencil elements, holding them tightly in place.

While the invention has been described with particular reference to the illustrated embodiments, numerous modifications thereto will appear to those skilled in the art.

Having thus described the invention, what we claim and desire to obtain by Letters Patent of the United States is:

1. A head assembly for mounting stencils across the discharge end of an apparatus adapted to direct a stream of abrasive particles toward said stencils for marking a work surface, comprising:

(a) an open ended cup adapted to fit snugly over said discharge end, said cup being of a relatively soft resilient material and formed with a forwardly facing inner shoulder adapted to bear against a cooperating rearwardly facing outer shoulder formed on said apparatus near said discharge end, (b) a stencil holder of a slightly flexible semi rigid material detachably connected to said cup across the open distal end thereof, (c) said holder being formed with at least one elongated aperture therein adapted to expose a plurality of stencil elements positioned in side-by-side abutting relation along said aperture, (d) a relatively stiff backing member generally coextensive with the rear face of said holder and detachably mountable thereto for holding said stencil elements in place formed with at least one elongated aperture in registration with said holder aperture, and, (e) at least one stencil mountable in said holder, (f) the forward portion of said cup being formed with parallel grooves along opposite edges thereof to slidably receive cooperating parallel opposite edges of said holder, (g) the front face of each stencil being flush with front face of said holder, (h) said holder being formed with a recess in the rear face thereof dimensioned to receive said backing member mountable in said recess said apertures defining a path for said particles to impinge and reproduce said stencil indicia on said work surface, (i) said stencil being generally U-shaped and formed with a cross-piece bearing a stencil indicia therein, a leg extending in the same directions perpendicularly from each of the upper and lower edges of said cross-piece and a flange extending in opposite directions perpendicularly from the ends of said legs, the height of said cross-piece generally corresponding to the height of said aperture and the length of said legs generally corresponding to the depth of said aperture.

2. A head assembly according to claim 1 wherein the flange on one of said legs differs from the flange on the other of said legs.

* * * * *